US005462568A

United States Patent [19]

Donatelli, Jr.

[11] Patent Number: 5,462,568

[45] Date of Patent: Oct. 31, 1995

[54] STONE POLISHING COMPOSITION

[75] Inventor: Joseph M. Donatelli, Jr., Scotch Plains, N.J.

[73] Assignee: Ronald C. Wiand, Troy, Mich.

[21] Appl. No.: 212,306

[22] Filed: Mar. 14, 1994

Related U.S. Application Data

[63] Continuation of Ser. No. 851,425, Mar. 13, 1992, abandoned.

[51] Int. Cl.[6] ..... B24B 7/22

[52] U.S. Cl. ..... 51/309; 451/283

[58] Field of Search ..... 106/3, 6; 51/293, 51/309, 283 R; 451/41

[56] References Cited

U.S. PATENT DOCUMENTS

| | | | |
|---|---|---|---|
| 3,385,682 | 5/1968 | Lowen | 51/293 |
| 3,768,989 | 10/1973 | Goetzinger et al. | 106/3 |
| 4,057,939 | 11/1977 | Basi | 106/3 |
| 4,169,337 | 10/1979 | Payne | 51/283 |
| 4,181,633 | 1/1980 | Colodney et al. | 106/3 |
| 4,218,250 | 8/1980 | Kasprzak | 106/3 |
| 4,462,188 | 7/1984 | Payne | 51/283 |
| 4,581,042 | 4/1986 | Willmore | 51/293 |
| 4,898,598 | 2/1990 | Zapata | 51/309 |
| 5,011,510 | 4/1991 | Hayakawa et al. | 51/293 |
| 5,104,421 | 4/1992 | Takizawa et al. | 106/3 |

*Primary Examiner*—Deborah Jones
*Attorney, Agent, or Firm*—Harnes, Dickey & Pierce

[57] ABSTRACT

A universal stone polishing composition which includes an abrasive constituent and a composition which is a source of Group Ia or Group IIa metal ions when mixed with water.

12 Claims, No Drawings

STONE POLISHING COMPOSITION

This is continuation of U.S. patent application Ser. No. 07/851,425, filed Mar. 13, 1992, now abandoned.

BACKGROUND OF THE INVENTION

The present invention relates to an improved polishing composition for polishing of marble, stone and granite surfaces.

For literally centuries the polishing of marble, stone or granite has been done using the same procedures and ingredients. The only differences in the present time is that motor driven equipment, (i.e. electric or gasoline motors) is presently used to do the work formerly done by hand. Polishing compositions which have been used over time have included mixtures of aluminum oxides, tin oxides, silicon carbides, pine resins, lead powders and lacquer resins. These ingredients, in powder form, are mixed in varying proportions determined by the empirical knowledge of the particular person doing the polishing, based on years of personal experience.

These powders are mixed with water, worked into a weak slurry or emulsion, by working with the polishing head through and around the water mixture. Usually, this is accomplished by applying about 8 ounces of water with one third of an ounce of the powdered polish mixture sprinkled on the water surface. In the past, this has been accomplished by first pouring the water on the floor and then sprinkling the dry powder mixture over the water, and thereafter working the powder into the surface.

While this process has satisfactorily polished marble floors and the like, there have been some disadvantages in this procedure. First of all, as stated above the actual proportions of ingredients incorporated were commonly prepared by the individual artisan and were not easily duplicated from one job to the next or one person to the next. A wide variety of skill levels could result wherein only the most skilled artisans could do the best job in polishing of the floor. Thus, some buildings having unskilled janitorial workers have found their marble and stone floors increasingly deteriorating in the polish achieved.

Secondly, in the past it has generally been necessary to use specifically designed formulas for different color marbles. It was not only necessary to use proper technique when polishing but also to use the proper mixture of materials. For instance, typically dark marbles are polished using lead wheels and aluminum oxides to add a darkening agent to the marble floors. However, such a combination readily discolors white marbles. Since white marbles are often interspersed among dark colored marbles the artisan could not readily polish both surfaces when intermixed. Additionally, the use of lead compositions or lead wheels is environmentally undesirable. Thus, it would be desirable in the art to provide a universal composition which could polish all types of marble without references to the color.

Prior art polishing compositions have typically been acid based. Thus, oxalic acids and other strong acids have been used. Such mixtures are somewhat temperamental and are undesirable due to worker contact with strong acids. Thus, an alkaline polishing composition may be preferable in some cases, but has not been available in the prior art polishing compositions.

In addition, because the materials were sprinkled on the floor as powders, the powders would sometimes become airborne or otherwise come in contact with the person. This may result in irritation of the skin or inhalation of the powders, both of which are undesirable to the artisans of the industry. Thus, it is also a goal in the art to provide a polishing composition which is free of oxalic acid, lead powders and other undesirable components.

SUMMARY OF THE INVENTION

In accordance with the present invention there is provided a polishing composition for universal polishing of any color marble. The compositions of the present invention include an abrasive constituent and a composition which forms Group Ia or Group IIa metal ions when mixed with water. Preferably, a carbonate source is also utilized in the subject compositions.

It is an object of the present invention to provide a universal marble or stone polishing composition which universally will polish any color of marble.

It is a further object of the present invention to reduce the use of undesirable components and polishes utilized in the past such as oxalate powders or lead powders.

It is a further object of the present invention to provide an alkaline polishing composition.

Further benefits and advantages of the present invention will become apparent from the subsequent description of the preferred embodiments and the appended claims.

DETAILED DESCRIPTION OF THE PREFERRED EMBODIMENTS

In its broadest aspects, the present invention includes two major constituents. The first constituent is an abrasive constituent which provides the abrasion aspects to the subject compositions. The second constituent is a composition which forms a Group Ia or Group IIa metal ion when mixed with water. The second constituent is critical in the present invention in that it allows for polishing of any color marble substrate and provides for improved polishing over prior art compositions without the use of oxalic acid powders, lead powders or other undesirable or noxious constituents in the mixture. Preferably, compositions in accordance with the present invention are alkaline and typically include carbonate as the alkaline component of the composition.

The abrasive constituent of the present invention includes at least in the preferred embodiment, abrasive grit particulate material such as aluminum oxide powders. However, other abrasives can be used such as tin oxides, zinc oxides and mixtures of these or other abrasives known in the art. Aluminum oxide acts as a refractory material for storing heat during abrasion. In a preferred embodiment zinc oxides and tin oxides may be added to provide faster heating of the compositions which speeds up the polishing process. Generally, particle sizes for use in the present invention include abrasive grits in the range of from about 0.5 to about 100 microns and preferably from about 2 to about 19 microns. The abrasive constituent may also include a resin constituent and other additions commonly included in polishing composition such as pine resins, lacquer resins and shellac resins or the like. Depending on the particular application these constituents may be adjusted and/or replaced or used in various combinations as will be appreciated by those skilled in the art.

In the present invention, the composition which provides the Group Ia or Group IIa metal ions may be a Group Ia or Group IIa metal carbonate composition provided the metal ion is released during mixture with water. The presence of a source of sodium ions is particularly preferred in the present invention. Many Group Ia or Group IIa alkali metals are useful in the present situation with other preferred metal ions including potassium and calcium which form ions in solution with water. In the preferred embodiment sodium carbonate compositions are utilized in polishing compositions of the present invention for this purpose. Other agents such as calcium carbonate and potassium carbonate may be utilized effectively in combination with sodium carbonate of the present invention. Without wishing to be bound by theory, it is believed that the combination of the $Ca^{+2}$ ion and the carbonate act to actually create a thin layer of the base stone on a marble surface which assists in smoothing out the rough "peaks and valleys" on the marble surface. This layer will build up on the stone and add to the smoothness of the surface due to the build up thereby rounding off "sharp" edges and adding to the gloss of the stone.

As stated above, the aluminum oxide grit is a refractory material which collects heat during the polishing operation. This acts in conjunction with the sodium, which acts as a flux, to melt the silicon containing elements of the marble providing further smoothing of the surface. Zinc and tin oxides may be used to increase the heat generated during polishing to allow this to occur more rapidly. Additionally, the sodium ions tend to displace some of the calcium ions in the stone to provide a buffering benefit to the stone.

In a preferred embodiment of the present invention, polishing compositions generally contain from about 50% to about 80% by weight of aluminum oxide, 10% to about 20% calcium carbonate and from about 10% to about 20% sodium carbonate. Typically, compositions of the present invention include from about 50% to about 60% by weight of aluminum oxide, 10% to about 20% by weight calcium carbonate and from about 10% to about 20% by weight sodium carbonate. In a preferred embodiment of the present invention about 80% by weight of 9–11 micron sized particles of a 99% pure aluminum oxide material is used, with about 10% calcium carbonate and 5% sodium carbonate by weight.

Polishing compositions of the present invention may be utilized in solutions in water of from about 0% to 99% water by volume. Preferably, the powders are to be mixed in a solution of from about 1% to about 50% water. Other suitable solutions may be utilized with lubricants and/or water intermixed with clay.

Polishing compositions of the present invention can be used in various forms as will be readily appreciated by those skilled in the art. In a first form, a polishing disk may be made wherein the powder is mixed with crushed felt and pressed into a flexible disk in a mold. The purpose of such a disk is to polish marble and granite in table tops, vanities, shelves or the like in manufacturing shops. The polishing composition of the present invention may also be put into edge polishing bar form for polishing marble and granite edges in manufacturing facilities, to facilitate the various desirabilities in the marketplace, utilizing this same press molding procedure.

Additionally, the polishing composition may be emulsified in a fine clay and lubricant which would allow the composition to be bottled and used for purposes of janitorial maintenance or the like. This composition can be applied to any marble floor and is an easy way for a janitorial staff to keep the floors highly polished without requirements of special knowledge in marble polishing or the like. The composition may also be used in this raw powder form for polishing floors with water and the like for those artisans which are more skilled in the art.

The polishing compositions of the present invention are universal in that only one composition is needed no matter the color of the marble substrate. Additionally, a suitable polish is achieved without the use of oxalic acids, lead powders or other noxious materials commonly considered essential in the past. Polishing compositions of the present invention are alkaline in nature and thus are preferable to acid based polishing compositions.

The following examples are given as further illustration of compositions of the present invention and are not to be construed to be limiting to the present invention.

EXAMPLE I

Polishing compositions were prepared in accordance with Table I below.

TABLE I

| Aluminum Oxide (in % by weight) | Sodium Carbonate (in % by weight) | Calcium Carbonate/ Potassium Carbonate (in % by weight) |
|---|---|---|
| 50% | 50% | — |
| 80% | 20% | — |
| 80% | 10% | 10% |
| 60% | 20% | 20% |

The above powder mixtures were mixed with water and utilized to polish dark marble, light marble and granites. Also, various colors of the polish obtained were superior with no discoloration to any of the marbles or granites.

While the above descriptions constitute the preferred embodiment of the present invention, it is to be appreciated that the invention is susceptible to modification, variation and change without departing from the proper scope and the fair meaning of the accompanying claims.

What is claimed is:

1. A process for polishing a marble, stone or granite surface comprising the steps of:

a) applying a polishing mixture comprising an abrasive constituent and a Group Ia or Group IIa metal ion source to said surface to be polished;

b) working said mixture against said surface for forming a crystal formation of said alkali group metal ion on said surface during polishing thereof.

2. The process according to claim 1 wherein said Group Ia or Group IIa metal ion source is selected from the group consisting of calcium carbonate, sodium carbonate and mixtures thereof.

3. The process according to claim 2 wherein said crystal formation is calcium carbonate.

4. The process of claim 2 wherein said crystal formation is sodium carbonate.

5. The process of claim 1, wherein said polishing mixture comprises from about 60% to about 80% by weight of the abrasive constituent; and from about 20% to about 40% by weight of the Group Ia or Group IIa metal ion source.

6. A process for polishing of a marble, stone or granite surface comprising:

applying a polishing mixture comprising an abrasive and a Group Ia or Group IIa metal ion source to a marble, stone or granite surface and polishing the surface with said polishing mixture.

7. The process according to claim 6 wherein said Group Ia or Group IIa metal ion source is selected from the group of calcium carbonate, sodium carbonate and mixtures thereof.

8. The process according to claim 6 wherein said polishing mixture comprises from about 60 to about 80% by weight of said abrasive and about 20 to about 40% by weight of said Group Ia or Group IIa metal ion source.

9. The process of claim 8 wherein the polishing mixture further includes a resin selected from the group consisting of shellac, pine, lacquer and mixtures thereof.

10. A process for polishing of a marble, stone or granite surface comprising:

applying a polishing mixture to the surface to be polished, said mixture comprising an abrasive having a grit size of from about 0.5 to 100 microns and selected from the group consisting of aluminum oxide, tin oxide, zinc oxide and mixtures thereof; and a Group Ia or Group IIa metal ion source selected from the group consisting of from about 10 to about 20% by weight of calcium carbonate, 15 to about 20% by weight of sodium carbonate or 15 to about 40% by weight of mixtures thereof; and polishing the surface with said polishing mixture.

11. The process of claim 10 wherein said polishing mixture comprises from about 50% to about 60% by weight aluminum oxide, from about 10% to about 20% by weight calcium carbonate and from about 5% to about 20% by weight sodium carbonate.

12. The process of claim 11 wherein the mixture includes a resin selected from the group consisting of shellac, pine, lacquer and mixtures thereof.

* * * * *

UNITED STATES PATENT AND TRADEMARK OFFICE

CERTIFICATE OF CORRECTION

PATENT NO. : 5,462,568

DATED : October 31, 1995

INVENTOR(S) : Joseph M. Donatelli, Jr.

It is certified that error appears in the above-indentified patent and that said Letters Patent is hereby corrected as shown below:

Column 5, line 7, claim 9, "8" should be --6--

Column 6, line 3, claim 10, "15" should be --5--

Column 6, line 12, claim 12, after "mixture" insert --further--

Signed and Sealed this

Twenty-sixth Day of March, 1996

*Attest:*

Bruce Lehman

BRUCE LEHMAN

*Attesting Officer*

*Commissioner of Patents and Trademarks*